United States Patent [19]

Grassl et al.

[11] Patent Number: 4,772,254

[45] Date of Patent: Sep. 20, 1988

[54] CENTRIFUGE

[75] Inventors: Alfred Grassl, Richterswil, Switzerland; Erhard Knorr, Wiesloch, Fed. Rep. of Germany

[73] Assignee: Kontron Holding A.G., Zurich, Switzerland

[21] Appl. No.: 937,264

[22] Filed: Dec. 3, 1986

[30] Foreign Application Priority Data

Dec. 11, 1985 [CH] Switzerland ..... 5285/85

[51] Int. Cl.[4] ..... B04B 15/00

[52] U.S. Cl. ..... 494/10

[58] Field of Search ..... 494/10, 9, 11; 340/671, 340/870.29, 870.31, 672; 324/174, 175

[56] References Cited

U.S. PATENT DOCUMENTS

| | | | |
|---|---|---|---|
| 4,551,715 | 11/1985 | Durbin | 494/10 |
| 4,601,696 | 7/1986 | Kamm | 494/10 |
| 4,663,601 | 5/1987 | Troutman | 340/870.31 |

*Primary Examiner*—Robert W. Jenkins

*Attorney, Agent, or Firm*—Jon S. Saxe; Bernard S. Leon; George W. Johnston

[57] ABSTRACT

A centrifuge having an interchangeable rotor provided with an information support means for machine-readable information, and a reader comprising detectors for scanning the information support means and an electronic circuit for processing the received information, the information support means comprising an array of permanent magnet pins distributed over the rotor and having in some cases their north poles and in other cases their south poles facing the detectors.

5 Claims, 2 Drawing Sheets

CENTRIFUGE

BACKGROUND

1. Field of the Invention

This invention relates to a centrifuge having an interchangeable rotor provided with an information support device for storing machine-readable information, and a reader comprising detectors for scanning the information support device, and an electronic circuit for processing the received information.

2. Description

Centrifuges are generally used for separating sample particles in a liquid medium. Various different kinds of rotors are available depending upon requirements, e.g. fixed angle rotors, swinging bucket rotors, vertical rotors, and zonal rotors.

The various rotors also differ in respect of performance, e.g. maximum attainable centrifugal force and maximum usable volume.

Since centrifuges are frequently used not just for one application, various interchangeable rotors are used for one and the same centrifuge. In no case may the maximum speed of the rotor used by exceeded.

Modern centrifuges, therefore, usually have a corresponding rotor-specific means of preventing excessive speed, e.g. optical scanning of a light/dark disc by an opto-coupler or similar methods or magnetic monitoring of a toothed disc or permanent magnets.

Both methods are adapted to generate a frequency which switches off the centrifuge drive if the permissible value is exceeded. In the case of centrifuges without vacuum facilities, the above mentioned monitoring is frequently eliminated. Protection against excess speed is provided by the air resistance.

High-speed centrifuges usually have cooling in order to keep the sample temperature inside the rotor constant. This type of centrifuge has no vacuum facilities of the kind required in even higher-speed ultracentrifuges.

The air resistance depending on the size, shape, surface and speed of the rotor used must be taken into account in the temperature control. This means that the cooling capacity must be appropriate for the purpose. This is achieved by a compensation circuit. The correct compensation value can be derived from the corresponding nomograms of the individual rotors.

In the case of centrifuges equipped with microprocessors it is only necessary to preselect the rotor type in order automatically to allow for compensation in connection with preselection of the temperature from the microprocessor memory. The same applies to partially evacuated centrifuges.

Many rotors, and particularly in the case of ultracentrifuges, are heavy-duty rotors, the use of which is limited by the total number of runs or running times or age. This necessitates keeping records of each run. Safety regulations in different countries expressly require this. Modern centrifuges have a printer which keeps a record of the runs provided the correct rotor type has previously been manually input.

The disadvantage of the technical solutions for keeping records is that the rotors are not automatically identified by the centrifuge. As a result, an error on the part of the user may make faulty operation possible so that inaccurate rotor records are retained. Rotors of excessive age are not recognized as such, and a sample in the rotor may not be kept at the required value due to false compensation of the centrifuge temperature control system.

SUMMARY OF THE INVENTION

The present invention concerns a centrifuge which obviates the above described disadvantages by providing accurate records on rotor runs.

According to the invention, there is provided an information support means which comprises an array of permanent magnet pins distributed over a centrifuge rotor. In some locations their north poles and in other locations their south poles face an electronic monitoring means such as a detector for receiving and detecting the information from the magnets and a circuit means for processing the information detected.

This positive rotor identification necessitates the rotor being coded in the factory. This coding may, for example, give the following information to the electronic monitoring means: year of construction, serial number, rotor type and permissible maximum speed.

In comparison with coding in the form of a bar code or similar systems, the magnetic pin coding is the most reliable contactless method because of the magnet durability and the permanence of the north or south pole alignment.

The magnets are disposed radially on the rotor at a predetermined location about the axis of rotation. Some of the magnets are used for speed monitoring and the others for coding. The two groups differ in their polarity.

BRIEF DESCRIPTION OF THE DRAWINGS

A preferred embodiment of the invention is described hereinbelow with reference to the accompanying drawings wherein.

DETAIL DESCRIPTION OF THE DRAWINGS

Figure 1:
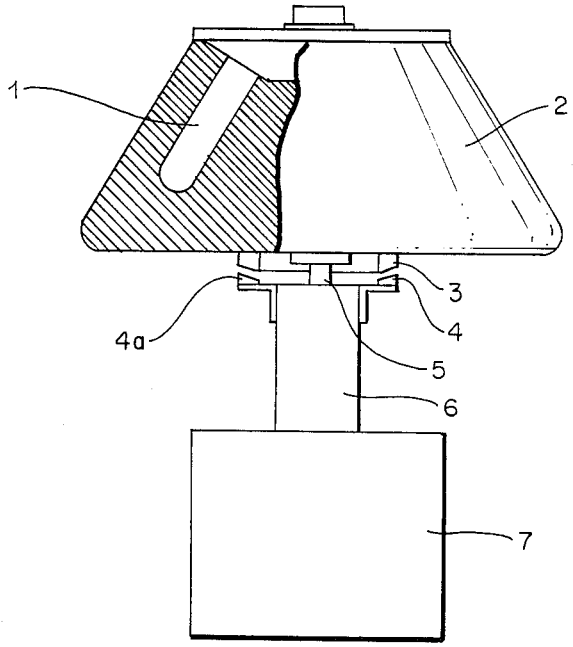
FIG. 1 is a diagrammatic side elevation, partly in cross-section of a centrifuge according to the invention.

The centrifuge illustrated in FIG. 1 is a fixed-angle centrifuge in which sample containers 1 are disposed in a rotor 2 at a predetermined angle of inclination. On the underside, the rotor bears a carrier ring 3 secured thereto to receive the coding in accordance with the invention.

Adjacent and beneath the ring 3 and opposite it, two sensors 4, **4*a*** are provided to scan the coding.

The rotor is driven by a drive shaft 5. The latter is mounted in a stationary bearing housing 6 and is driven by a drive unit 7.

Figure 2:
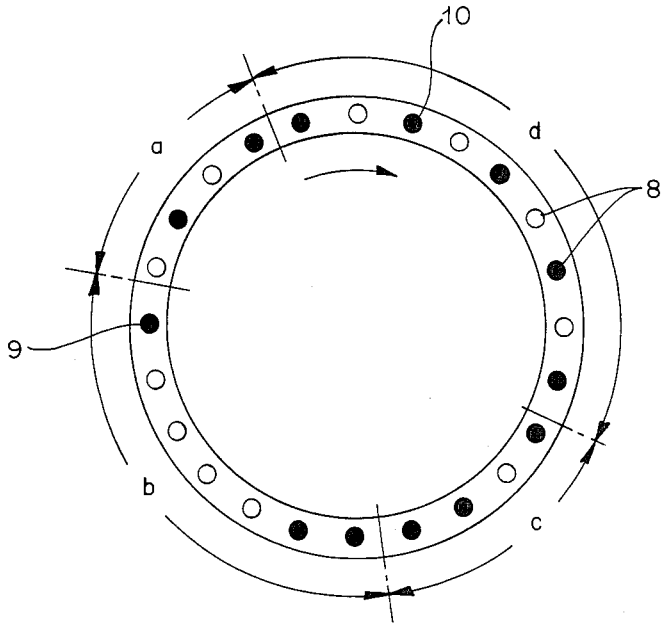
FIG. 2 diagrammatically illustrates the coding ring of the rotor of the centrifuge in FIG. 1.
Figure 3:
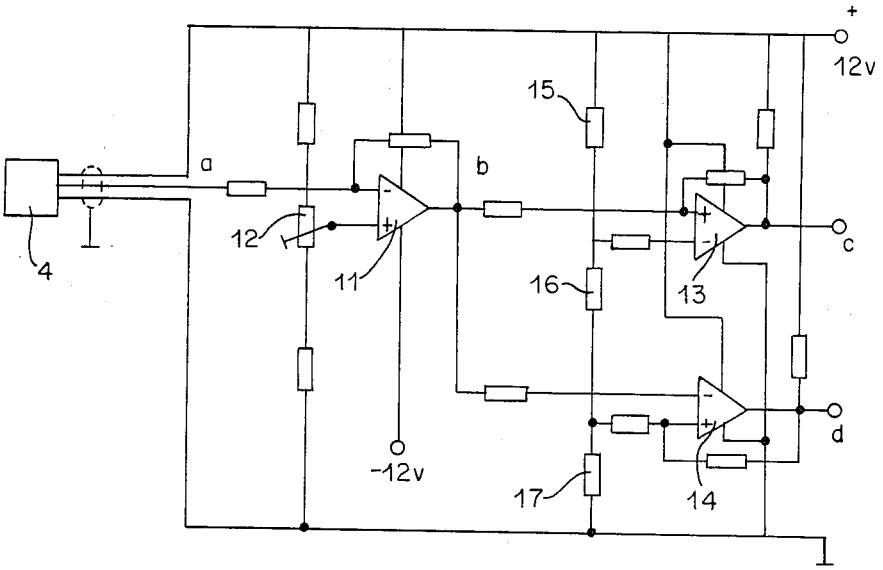
FIG. 3 is a diagram showing the circuit for detecting a coding for the centrifuge according to the invention.

The end face of the carrier ring 3 is shown in FIG. 2. It has 24 boreholes 8 distributed uniformly over its periphery. at a (at least one) predetermined radial distance from the axis of rotation to receive matching permanent magnet pins 9, 10. The magnet pins are so inserted that in some cases their south poles and in others their north poles extend outwardly away from the ring 3. The orientation of the magnets and/or their presence or absence permits use of a binary coding system (0 or 1) uniquely to identify each centrifuge rotor.

A relatively large amount of information can be coded by the use of the north and south poles of magnet pins 9 and 10. For example, in FIG. 2, *15* positions of sectors a, b and c, and hence 15 bits, are available for rotor information identification. In these 15 positions inserted pins have their north poles extending outwardly. They are divided up into 4 bits (sector a) for the year of construction, 7 bits (sector b) for the serial number, and 4 bits (sector c) for the rotor type.

The magnet pins of the sector d have their south poles extending outwardly away from the ring 3 and are used for coding the speed of the centrifuge.

The indicator ring 3 illustrated as an example in FIG. 2 forms part of a rotor having the year code (base two read in reverse sequence because of the direction of rotation, with an empty circle (i.e., no magnet) being 0 and a filled-in circle being 1 (i.e., magnet present) 1010 corresponding to 5 to indicate 1985, the serial number 1000011 corresponding to 97, rotor type 1101 corresponding to 11, with maximum permissible speed 101010101 corresponding to 25200 rpm.

The invention utilizes a microprocessor which requires a starting bit to recognise the start of the coding. Since the magnets for the speed monitoring are inserted in a different polarity from the coding magnets, the starting information is thus obtained automatically from the change of polarity due to rotation.

The above aspect of the invention permits identification only on rotation. A coding disposed on the rotor or carrier ring parallel to the axis of rotation would enable the information regarding the rotor to be detected when the rotor 2 is fitted onto the shaft 5. This constitutes another embodiment contemplated as being within the invention.

The use of a second sensor (4*a*) allows both the speed and the above-noted coding to be monitored independently with no electrical connections, so that even the most demanding safety regulations can be met.

Figure 4:
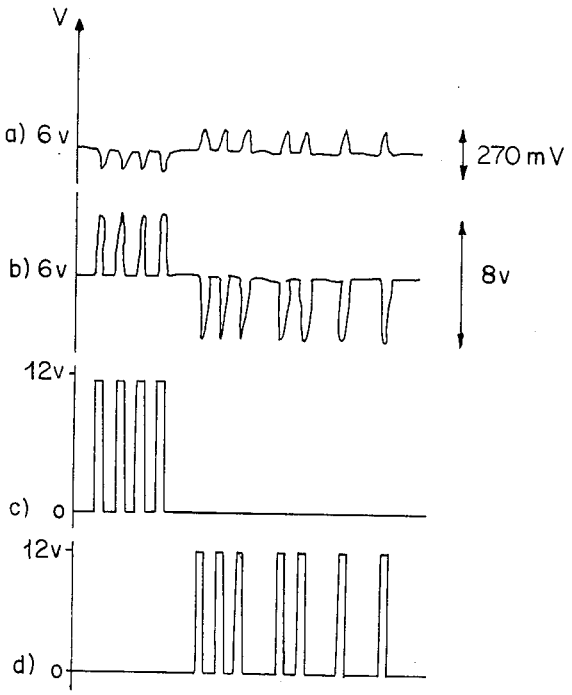
FIG. 4 is a graph showing volts as a functions of time for a circuit utilized with the centrifuge.

The circuit shown as an example in FIG. 4 for detecting the coding is constructed as follows, the signal diagrams in FIG. 4 being referred to at the same time.

The magnetic sensor 4 has a +12 volt supply. The signal output has a d.c. potential of +6 volts.

The magnets rotating past the sensor (4 or 4*a*) generate pulses with a signal voltage of about 270 mVss. These are superimposed on the output voltage (FIG. 4*a*). The sensor 4 is connected to the inverting input of an operational amplifier 11. The signal is amplified about 30 times and inverted in the operational amplifier 11 (FIG. 4*b*). A potentiometer 12 feeds the other input of the amplifier 11 with a bias voltage which keeps the output at +6 volts.

The output of the amplifier 11 is connected to the non-inverting input of an operational amplifier 13 and to the inverting input of an operational amplifier 14. The second input of the amplifier 13 is set to a bias of about 8 volts by means of the resistors 15, 16, 17. This ensures that only the positive peaks of the output signal of the amplifier 11, which are free of interference, are converted to a rectangular signal (FIG. 4*c*). The second input of the amplifier 14 between the resistors 16 and 17 is at a voltage of 4 volts. In this way it inverts the negative pulses of the signal 46 and also delivers a rectangular signal (FIG. 4*d*).

The output of the amplifier 13 (FIG. 4*c*) is fed to a speed monitor (not shown) while the output signal of the amplifier 14 (FIG. 4*d*), which contains the rotor coding, is fed for processing to a microprocessor (not shown).

While the invention has been described in conjunction with certain embodiments, it is understood that various modifications and changes may be made without departing from the spirit and scope of the invention. For example, the carrier ring 3 could be integrally formed with the rotor 2.

We claim:

1. A centrifuge comprising an interchangeable rotor provided with an information support carrying a circular array of permanent magnets, a predetermined number of the magnets with some having their north poles exposed and the remaining magnets having their south poles exposed, and a reader having detectors for scanning the information support and an electronic circuit for processing the information received from the information support, wherein the magnets are arranged in two separate groups of different polarity, such that each group is adapted for information coding independently from the respective other group.

2. A centrifuge having an interchangeable rotor comprising:

(a) information support means secured to the rotor for storing machine readable information and having a plurality of permanent magnets secured to the rotor;

(b) reader means for detecting and receiving machine readable information from the magnets;

(c) circuit means for processing the information obtained by the reader means, thereby to permit positive identification of the centrifuge rotor; and (d) the magnets being arranged in two separate groups, the first group having all their north poles facing the reader means, the second group having all their south poles facing the reader means.

3. The centrifuge of claim 2, wherein the reader means comprises at least one sensor positioned to receive magnetic machine readable information from the magnets.

4. The centrifuge of claim 3, wherein the information support means comprises a carrier ring secured to the rotor for rotation therewith, and having a plurality of apertures located at a predetermined distance from the axis of rotor rotation and dimensioned to receive the magnets.

5. A centrifuge having an interchangeable rotor with an end face comprising:

(a) information support means having;

(i) a plurality of permanent magnets for providing machine readable information; and (ii) a carrier ring secured to the end face of the rotor for rotation therewith about the same axis of rotation and having a plurality of apertures configured and dimensioned to receive and hold the magnets;

(b) at least one magnet sensor positioned on the centrifuge to detect magnetic machine readable information from the magnets;

(c) circuit means for processing the information detected by the sensor thereby to permit positive identification of the centrifuge rotor; and (d) the magnets being arranged in two separate groups, the first group having all their north poles facing the sensor, the second group having all their south poles facing the sensor.

* * * * *